US012330263B2

(12) United States Patent
Chuang et al.

(10) Patent No.: US 12,330,263 B2
(45) Date of Patent: Jun. 17, 2025

(54) GRINDING MACHINE WITH MOVABLE GRINDING WHEELS

(71) Applicant: YEON CHUAN MACHINERY CO., LTD., Taichung (TW)

(72) Inventors: Po Chang Chuang, Taichung (TW); Sz Lin Chen, Taichung (TW)

(73) Assignee: Yeon Chuan Machinery Co., Ltd., Taichung (TW)

( * ) Notice: Subject to any disclaimer, the term of this patent is extended or adjusted under 35 U.S.C. 154(b) by 419 days.

(21) Appl. No.: 17/805,107

(22) Filed: Jun. 2, 2022

(65) Prior Publication Data

US 2023/0211459 A1 Jul. 6, 2023

(30) Foreign Application Priority Data

Jan. 3, 2022 (TW) ..... 111200017

(51) Int. Cl.

| | |
|---|---|
| ***B24B 7/07*** | (2006.01) |
| ***B24B 7/08*** | (2006.01) |
| ***B24B 9/00*** | (2006.01) |
| ***B24B 41/047*** | (2006.01) |
| ***B24B 47/12*** | (2006.01) |

(52) U.S. Cl.

CPC ..... *B24B 47/12* (2013.01); *B24B 9/002* (2013.01)

(58) Field of Classification Search

CPC ..... B24B 47/12; B24B 9/002; B24B 7/06; B24B 7/12; B24B 27/00; B24B 27/0076; B24B 27/0084; B24B 41/00; B24B 41/02; B24B 41/04; B24B 55/06; B24B 7/28; B24B 41/047; B24B 21/22

USPC ..... 451/121, 124, 130, 179

See application file for complete search history.

(56) References Cited

U.S. PATENT DOCUMENTS

| | | | | |
|---|---|---|---|---|
| 2,587,177 A * | 2/1952 | Larson | B25H 1/04 | 144/286.1 |
| 3,566,546 A * | 3/1971 | Lindmark | B24B 21/12 | 451/302 |
| 3,708,817 A * | 1/1973 | Rhine | B24D 13/10 | 451/130 |
| 4,955,941 A * | 9/1990 | Rousseau | B23Q 1/74 | 108/65 |
| 6,299,512 B1 * | 10/2001 | Costa | B24B 7/28 | 451/300 |
| 6,722,966 B1 * | 4/2004 | Wang | B24B 21/22 | 451/310 |
| 6,860,797 B1 * | 3/2005 | Chuang | B24B 7/02 | 451/157 |

(Continued)

*Primary Examiner* — Eileen P Morgan
(74) *Attorney, Agent, or Firm* — Rosenberg, Klein & Lee

(57) ABSTRACT

A grinding machine includes a main part and an end case. A driving unit is connected to the end case and includes a first motor which has an output shaft with a groove. A grinding unit is connected to the end case, and cantilevered above the main part. The grinding unit includes a grinding wheel set which has a central axle with a slide. The slide is located in the groove of the output shaft of the first motor. A driving wheel is connected to the central axle. An adjustment device includes a second motor which drives an eccentric unit that has an eccentric axle, and the eccentric axle extends through a bearing which is located in a recess formed to the driving wheel. The driving wheel is driven by the eccentric unit to move the grinding wheel set of the grinding unit left and right.

9 Claims, 7 Drawing Sheets

(56) References Cited

U.S. PATENT DOCUMENTS

| | | | | |
|---|---|---|---|---|
| 6,881,136 | B1 * | 4/2005 | Chuang | B24B 47/00 451/310 |
| 7,014,544 | B2 * | 3/2006 | Huang | B24B 7/28 451/130 |
| 7,090,569 | B1 * | 8/2006 | Chang | B24B 21/22 451/167 |
| 7,572,170 | B2 * | 8/2009 | Chang | B24B 7/00 451/130 |
| 8,287,335 | B2 * | 10/2012 | Chang | B24B 7/075 451/11 |
| 9,950,403 | B2 * | 4/2018 | Kröplin | B24B 47/10 |
| 10,773,354 | B2 * | 9/2020 | Chuang | B24B 7/08 |
| 2003/0124961 | A1 * | 7/2003 | Haney | B24B 9/00 451/182 |
| 2005/0287935 | A1 * | 12/2005 | Huang | B24B 7/28 451/124 |
| 2016/0332275 | A1 * | 11/2016 | Kröplin | B24B 9/002 |

* cited by examiner

GRINDING MACHINE WITH MOVABLE GRINDING WHEELS

BACKGROUND OF THE INVENTION

1. Fields of the Invention

The present invention relates to a grinding machine, and more particularly, to a grinding machine with movable grinding wheels that move transversely relative to the axis to the machine to provide wide area of grinding.

2. Descriptions of Related Art

The conventional grinding machine is used to remove surplus material on edges of metal or wood objects. The grinding machine also properly polish surfaces of the objects.

As shown in FIG. 7, U.S. Pat. No. 10,773,354 discloses a grinding machine 9 with transverse moving unit, and includes a first motor 91 connected with a cam handle 92, and the cam handle 92 is connected to the inner end of the grinding unit 93. The cam handle 92 includes an eccentric axle 921 which drives the grinding unit 93 to move left and right. In addition, there is a second motor 94 is drives the grinding unit 93 to rotate the grinding unit 93. Therefore, the grinding unit 93 is able to rotate and move left and right.

However, the cam handle 92 includes multiple parts and a complicated structure, and it takes a lot of time to move the grinding unit 93 to move left and right while it is rotating. In addition, the cam handle 92 is driven by the first motor 91 which accelerates the rotation of the cam handle 92 so that the grinding result is not even.

The present invention intends to provide a grinding machine to eliminate the shortcomings mentioned above.

SUMMARY OF THE INVENTION

The present invention relates to a grinding machine and comprises a base having a main part and an end case that is connected to one end of the main part. A driving unit is connected to the end case and includes a first motor which has an output shaft, and a groove is defined axially in the distal end of the output shaft of the first motor. A grinding unit has one of two ends thereof connected to the end case, and another one of the two ends of the grinding unit is cantilevered above the main part. The grinding unit includes a hood and a grinding wheel set. The hood is mounted above the grinding wheel set. The grinding wheel set includes a central axle which has a slide. The slide is located in the groove of the output shaft of the first motor. A driving wheel is connected to the central axle. An adjustment device includes a second motor which is connected to an eccentric unit. The eccentric unit includes an eccentric axle and a bearing. The eccentric axle extends through the bearing, and the bearing is located in a recess formed to the driving wheel. The driving wheel is driven by the eccentric unit of the adjustment device to move the grinding wheel set of the grinding unit transversely.

Preferably, the grinding unit includes a first axis. The adjustment device includes a second axis which is perpendicular to the first axis. The eccentric unit of the adjustment device is connected to the driving wheel of the grinding unit, so that the grinding unit moves along the first axis.

Preferably, the main part of the base includes two boards respectively extend toward two sides of the main part. The base includes a feeding device connected to the main part.

Preferably, the end case includes a crank connected thereto. The end case is movably connected to two guide pillars which are fixed to the base. The end case is adjusted along the two guide pillars by rotating the crank.

Preferably, a hook is connected to the base. The second motor is set to operate at a constant speed selected from variable speeds.

The eccentric unit of the adjustment device is located in the recess of the driving wheel of the grinding unit, when the eccentric unit of the adjustment device is operated, the grinding unit is move along the axis of the central axle. The acceleration of the eccentric unit is table so that the grinding unit grinds the object stably. The present invention uses a simple structure to lower the manufacturing cost and reduce the weight, and the assembly and maintenance are also improved.

The eccentric unit of the adjustment device drives the grinding unit to move back and forth within the hood so as to grind a larger and wider area of the objects.

The boards on two sides of the main part support the object, and the feeding device feeds the object at a constant speed so that the quality of grinding of the present invention is enhanced.

The height of the grinding unit relative to the main part is adjustable by operating the crank so as to grind the objects of different thicknesses.

The second motor of the adjustment device is activated according to the width of the object to be ground, the present invention is able to grind small and large objects.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
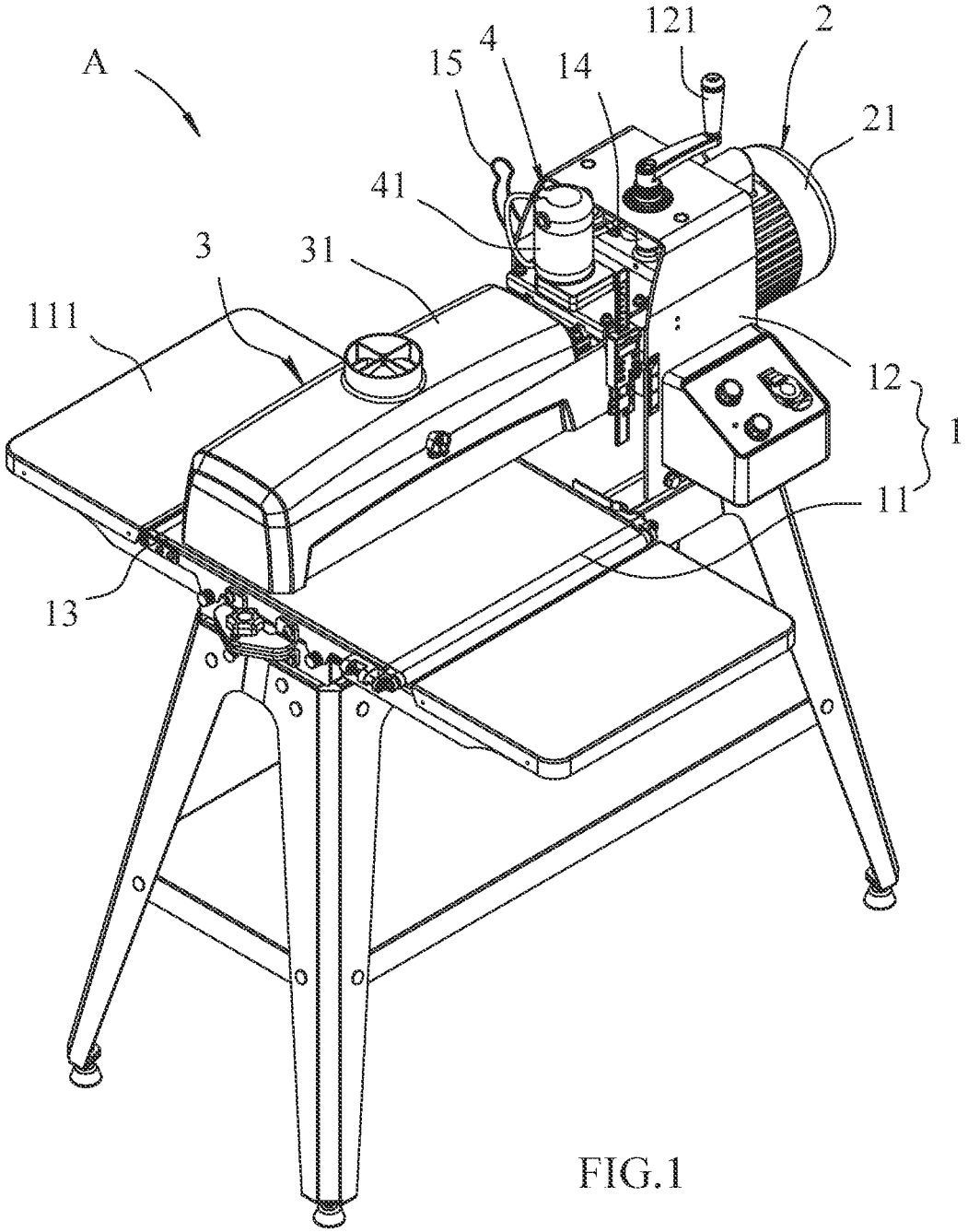
FIG. 1 is a perspective view to show the grinding machine of the present invention.
Figure 2:
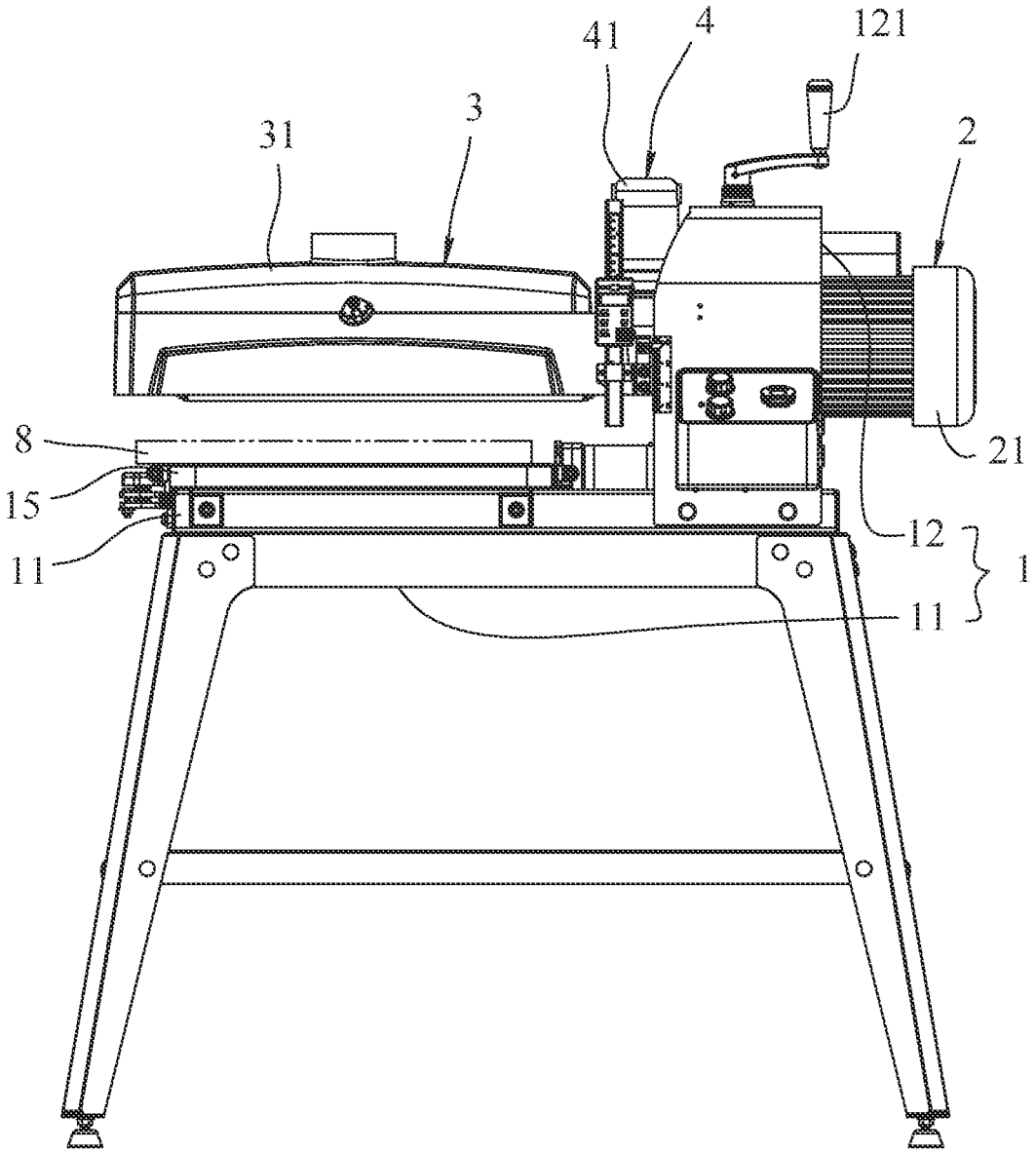
FIG. 2 is a side view of the grinding machine of the present invention.
Figure 3:
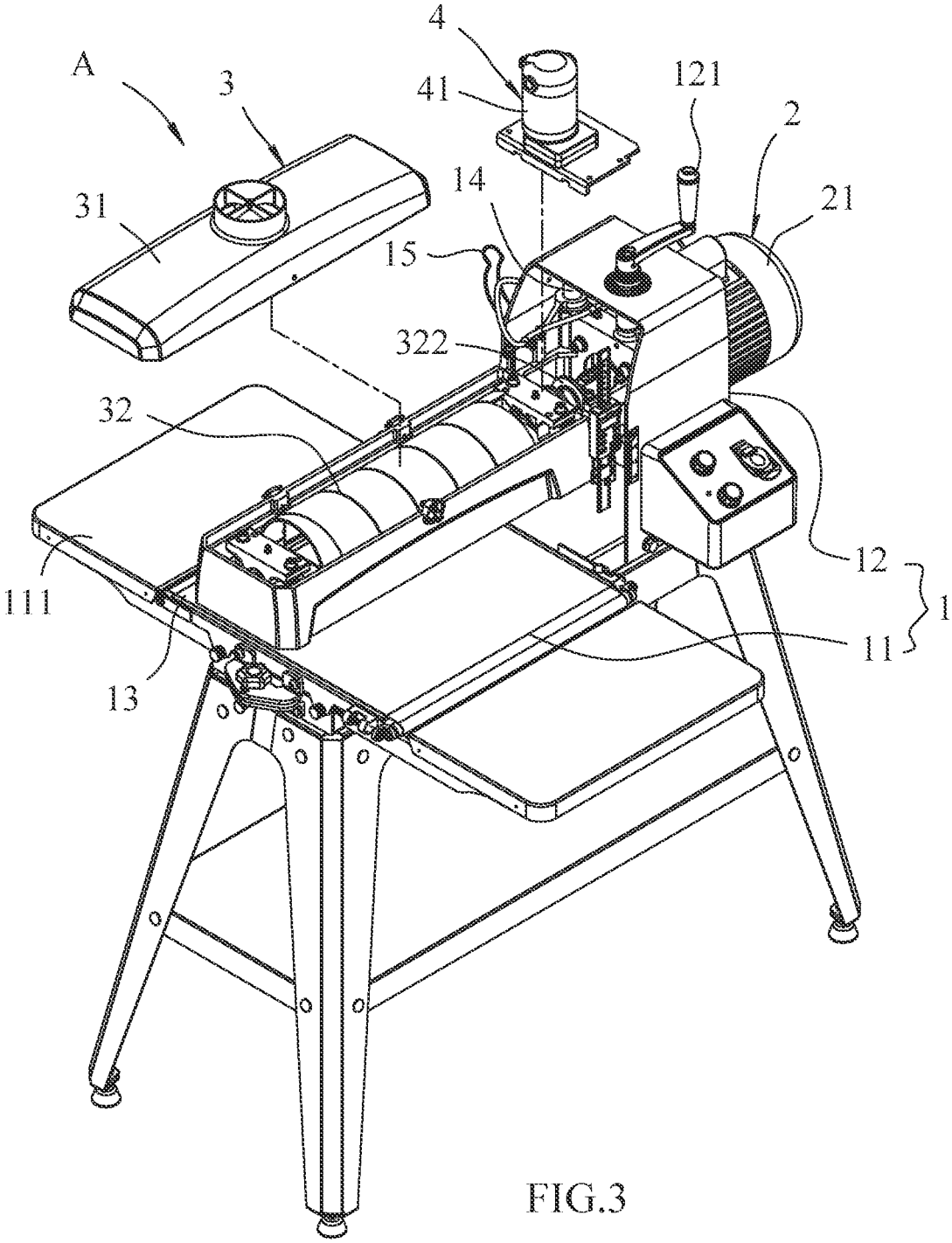
FIG. 3 is an exploded view of the grinding machine of the present invention.

Referring to FIGS. 1 to 3, the grinding machine "A" of the present invention comprises a base 1, a driving unit 2, a grinding unit 3 and a adjustment device 4. The base 1 includes a main part 11 and an end case 12 is connected to one end of the main part 11. The base 1 includes a feeding device 13 connected to the main part 11, and the feeding device 13 uses a belt to be connected to the main part 11 so as to feed an object 8 to be ground. The main part 11 of the base 1 includes two boards 111 which are respectively and pivotably connected to the main part 11 and extend toward two sides of the main part 11. A hook 15 is connected to the base 1 so as to position a sucking hose for sucking dust from the object 8.

The end case 12 includes a crank 121 connected to the top of the end case 12. The base 1 includes two guide pillars 14 which are fixed to the base 1, and the end case 12 is movable and adjusted along the two guide pillars 14 by rotating the crank 121. The height of the grinding unit 3 relative to the main part 11 is adjustable by operating the crank 121 so as to grind the objects of different thicknesses.

As shown in FIGS. 2 to 6, the driving unit 2 is connected to the end case 12 and includes a first motor 21 which has an output shaft. An end part is connected to the distal end surface of the output shaft of the first motor 21, and a groove 22 defined axially in the end part.

The grinding unit 3 has one of two ends thereof connected to the end case 12, and another one of the two ends of the grinding unit 3 is cantilevered above the main part 11. The grinding unit 3 includes a hood 31 and a grinding wheel set 32, wherein the hood 31 is mounted above the grinding wheel set 32. The grinding wheel set 32 includes a central axle 321 which has a slide 33. The slide 33 is located in the groove 22 of the output shaft of the first motor 21. A driving wheel 322 is connected to the central axle 321. The central axle 321 is connected to the output shaft of the first motor 21 by the slide 33 located in the groove 22 of the end part. The driving unit 2 is connected to and drives the grinding unit 3. The grinding unit 3 includes a first axis 30.

Figure 4:
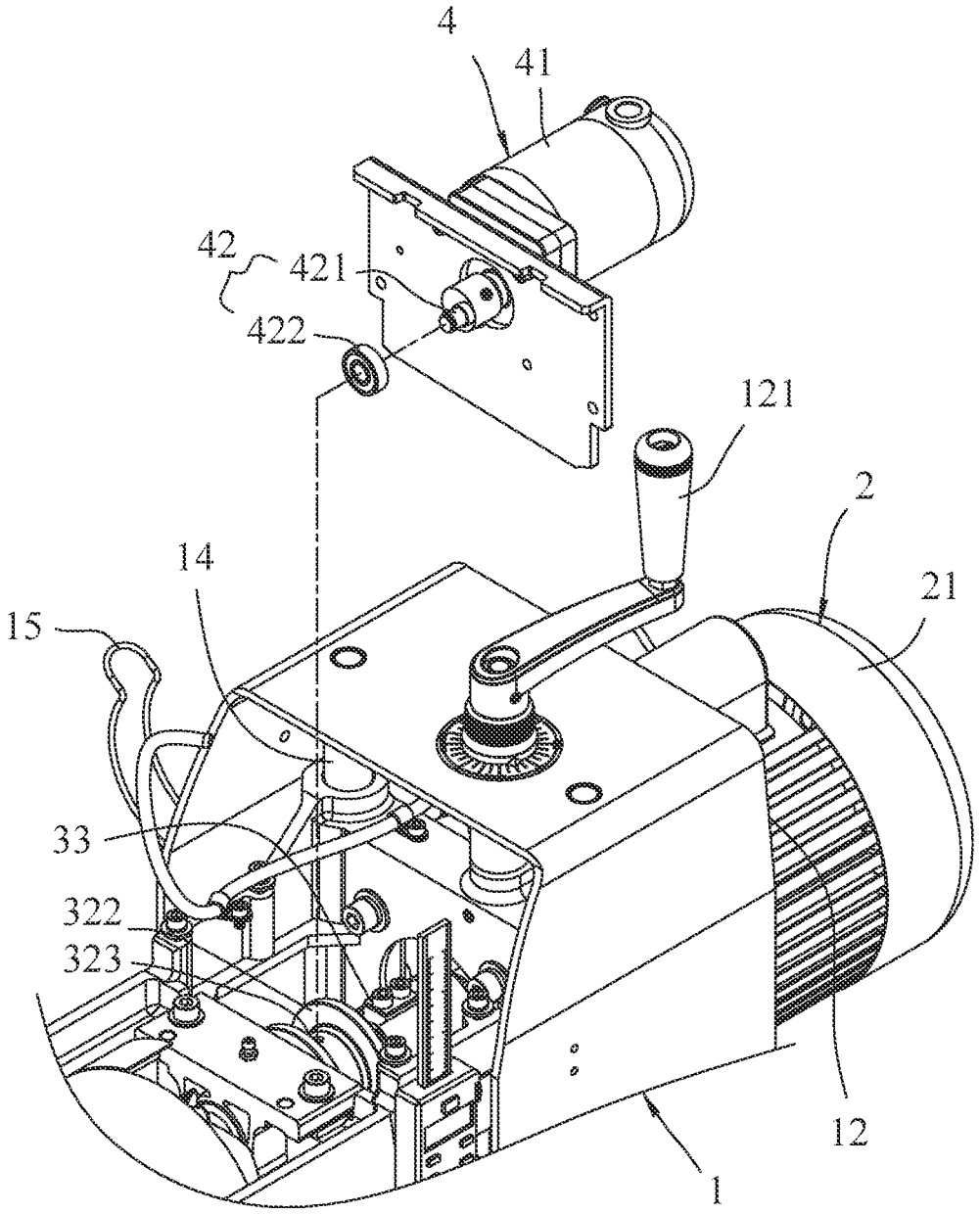
FIG. 4 is an enlarged view to show the grinding machine of the present invention.
Figure 5:
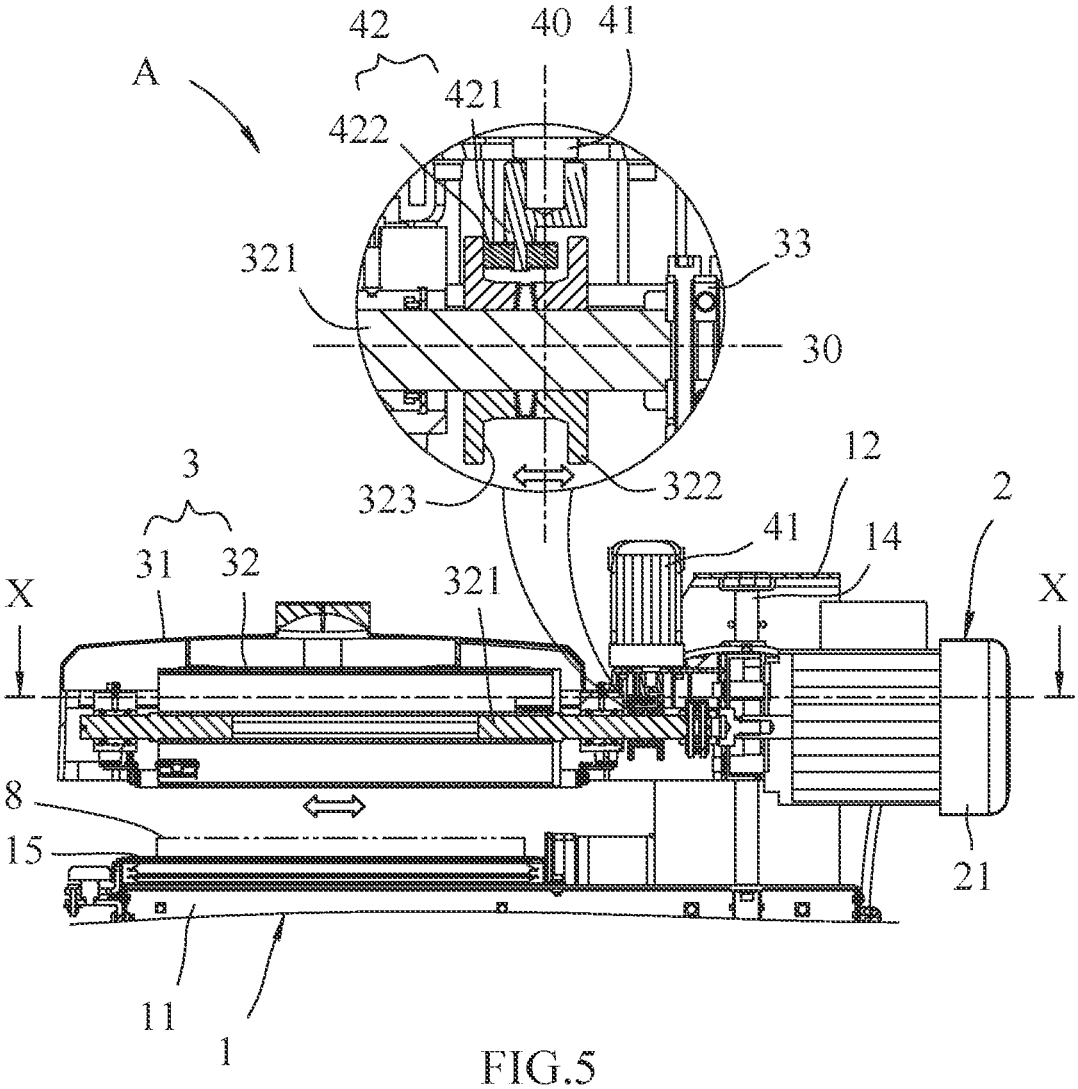
FIG. 5 is a side cross sectional view of the grinding machine of the present invention.

The adjustment device 4 includes a second motor 41 which is connected to an eccentric unit 42. The eccentric unit 42 includes an eccentric axle 421 and a bearing 422. The eccentric axle 421 extends through the bearing 422, and the bearing 422 is located in a recess 323 formed to the driving wheel 322 as shown in FIGS. 4 and 5. The adjustment device 4 includes a second axis 40 which is perpendicular to the first axis 30. The eccentric unit 42 of the adjustment device 4 is connected to the driving wheel 322 of the grinding unit 3, so that the grinding unit 3 moves along the first axis 30 when the eccentric axle 421 is rotated. The second motor 41 is set to operate at a constant speed selected from variable speeds.

Therefore, the first driver 21 drives the central axle 321 of the driving wheel 322 of the grinding unit 3 to as to operate the grinding unit 3 to grind the objects 8. The adjustment device 4 uses the bearing 422 of the eccentric unit 42 to be located in the recess 323 of the driving wheel 322 so as to move the central axle 321 of the driving wheel 322 of the grinding unit 3 left and right, such that the grinding unit 3 is movable to provide a wider or larger area of grinding to the objects 8.

The grinding unit 3 is rotated to grind objects 8 by the first motor 21 driving the central axle 321. When a larger object 8 is to be ground, the second motor 41 is operated, because the eccentric unit 42 of the adjustment device 4 is connected to the driving wheel 322 of the grinding unit 3, so that the grinding unit 3 is moved left and right along the first axis 30, in the same time, because the slide 33 is restricted within the groove 22 of the end part, the grinding unit 3 is moved linearly. Therefore, the area that the grinding unit 3 grinds the object 8 is larger and wider. The cooperation between the driving unit 2 and the adjustment device 4 maintain the grinding unit 3 to be operated stably without shaking.

Figure 6:
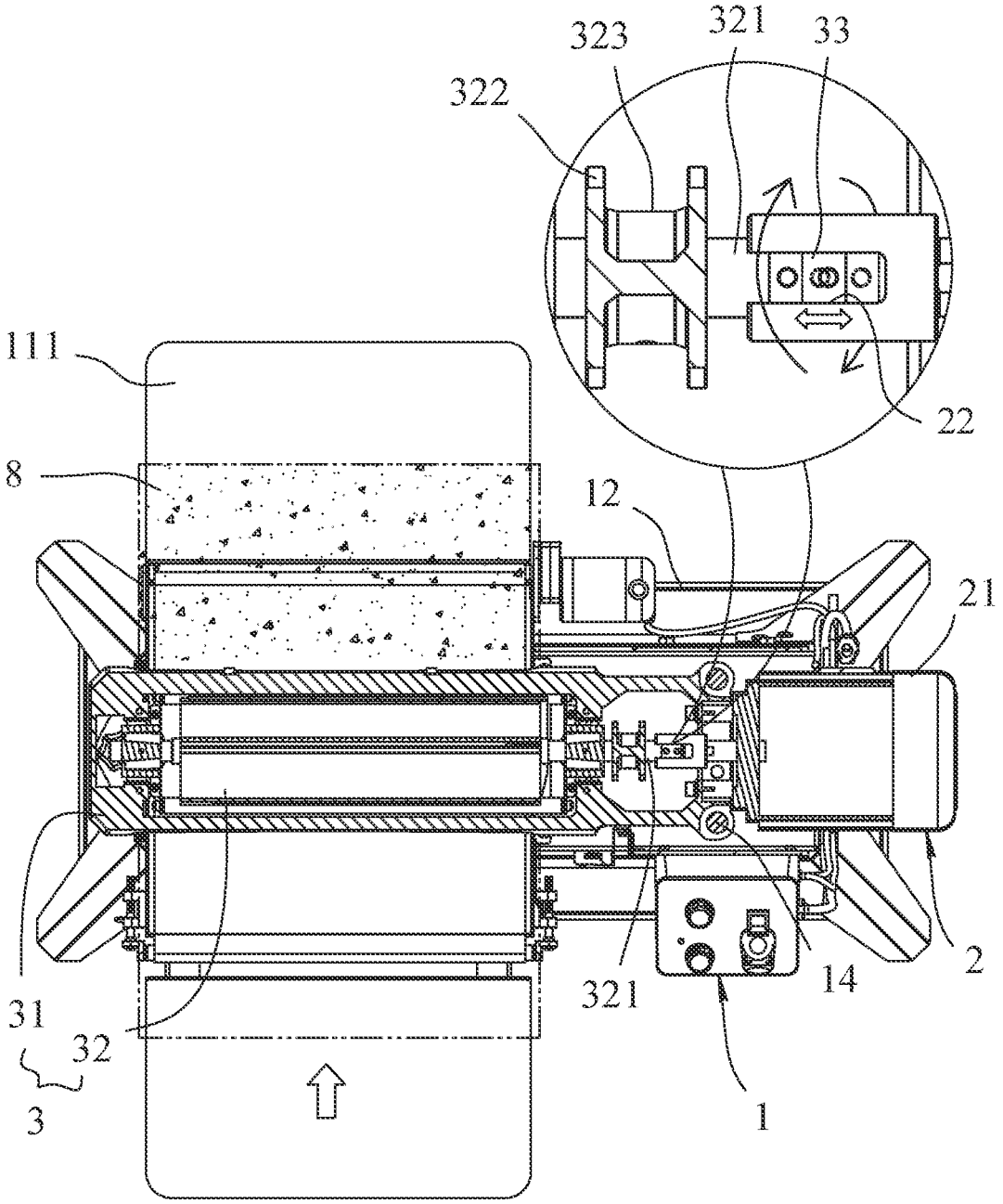
FIG. 6 is a cross sectional view, taken along line X-X in FIG. 5.
Figure 7:
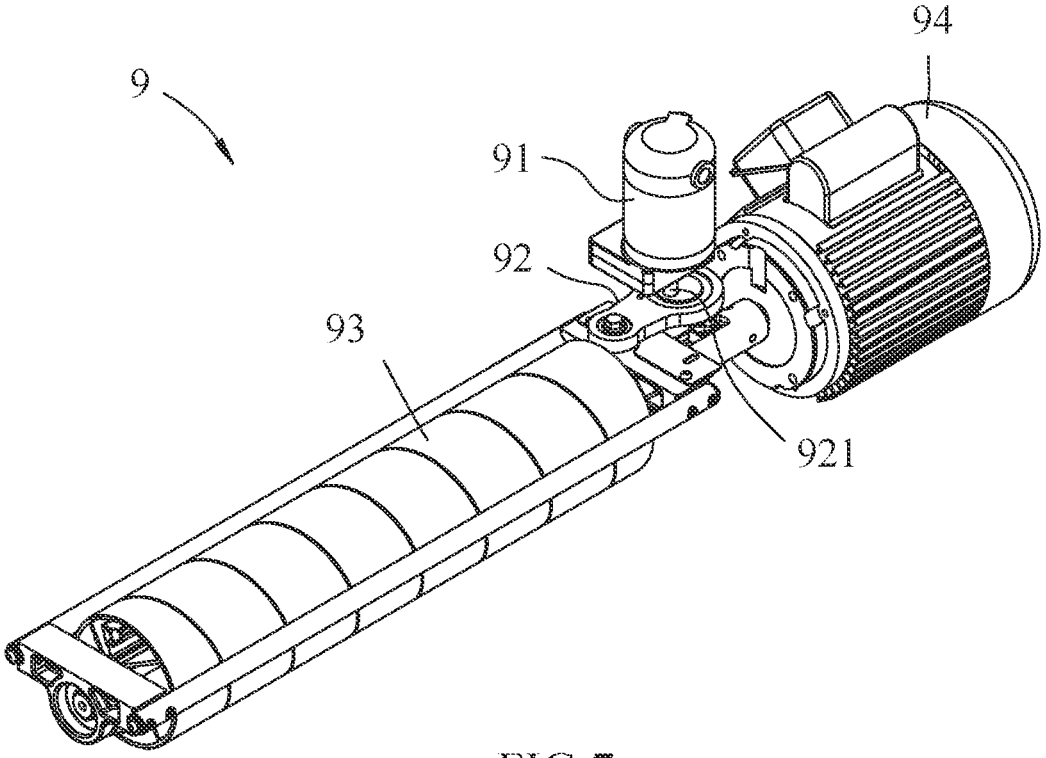
FIG.7 PRIOR ART
FIG. 7 shows a conventional grinding machine.

As shown in FIG. 6, the object 8 is put on the feeding device 13, and the two boards 111 support the object 8 to be maintained horizontally, so that the result of the grinding is improved.

While we have shown and described the embodiment in accordance with the present invention, it should be clear to those skilled in the art that further embodiments may be made without departing from the scope of the present invention.

What is claimed is:

1. A grinding machine comprising:

a base having a main part and an end case connected to one end of the main part;

a driving unit connected to the end case and including a first motor which has an output shaft, a groove formed axially in a distal end surface of the output shaft of the first motor;

a grinding unit having one of two ends thereof connected to the end case, another one of the two ends of the grinding unit cantilevered above the main part, the grinding unit including a hood and a grinding wheel set, the hood being mounted above the grinding wheel set, the grinding wheel set including a central axle which has a slide, the slide being located in the groove of the output shaft of the first motor, a driving wheel connected to the central axle;

an adjustment device including a second motor which is connected to an eccentric unit, the eccentric unit including an eccentric axle and a bearing, the eccentric axle extending through the bearing, and the bearing located in a recess formed to the driving wheel, and the driving wheel being driven by the eccentric unit of the adjustment device to move the grinding wheel set of the grinding unit.

2. The grinding machine as claimed in claim 1, wherein the central axle of the grinding unit defines a first axis, and the second motor of the adjustment device defines a second axis which is perpendicular to the first axis, and wherein the eccentric unit of the adjustment device is connected to the driving wheel of the grinding unit, so that the grinding unit is driven by the eccentric unit to move longitudinally along the first axis.

3. The grinding machine as claimed in claim 1, wherein the main part of the base includes two boards respectively extending toward two sides of the main part, and the base includes a feeding device connected to the main part.

4. The grinding machine as claimed in claim 1, wherein the end case includes a crank connected thereto, the end case being movably connected to two guide pillars which are fixed to the base, the end case being adjustable along the two guide pillars by rotation of the crank.

5. The grinding machine as claimed in claim 1, wherein the second motor is set to operate at a constant speed selected from variable speeds and independent of a speed of the first motor, rotational motion of the central axle being driven by the first motor, longitudinal motion of the central axle being driven by the second motor independently of the rotational motion.

6. The grinding machine as claimed in claim 1, wherein the driving wheel is formed to surround a portion of the central axle.

7. The grinding machine as claimed in claim 1, wherein the recess is formed in a circumferential surface of the driving wheel.

8. The grinding machine as claimed in claim 1, wherein the eccentric axle extends into the recess of the driving wheel.

9. The grinding machine as claimed in claim 1, wherein the bearing is configured to engage against a side surface of the recess of the driving wheel to drive movement of the grinding wheel set of the grinding unit.

* * * * *